US010036401B2

(12) United States Patent
Hackett et al.

(10) Patent No.: US 10,036,401 B2
(45) Date of Patent: Jul. 31, 2018

(54) RECIRCULATING PUMP INLET

(71) Applicant: Caterpillar Inc., Peoria, IL (US)

(72) Inventors: David E. Hackett, Washington, IL (US); Scott F. Shafer, Morton, IL (US)

(73) Assignee: Caterpillar Inc., Deerfield, IL (US)

( * ) Notice: Subject to any disclaimer, the term of this patent is extended or adjusted under 35 U.S.C. 154(b) by 546 days.

(21) Appl. No.: 14/689,280

(22) Filed: Apr. 17, 2015

(65) Prior Publication Data

US 2016/0305444 A1 Oct. 20, 2016

(51) Int. Cl.
*F04D 29/42* (2006.01)

(52) U.S. Cl.
CPC ..... *F04D 29/4273* (2013.01); *F04D 29/4293* (2013.01)

(58) Field of Classification Search
CPC ..... F04D 29/42; F04D 29/403; F04D 29/406; F04D 29/4273; F04D 29/4293; F04D 29/428; F04D 29/445; F04D 29/4233; F04D 29/424; F05D 2250/51
USPC ..... 415/56.5
See application file for complete search history.

(56) References Cited

U.S. PATENT DOCUMENTS

| | | | | |
|---|---|---|---|---|
| 1,839,032 | A * | 12/1931 | Jacobsen | F04D 9/02 415/56.5 |
| 3,625,820 | A * | 12/1971 | Gluntz | F04F 5/46 376/372 |
| 3,734,292 | A | 5/1973 | Bell | |
| 5,100,289 | A * | 3/1992 | Caoduro | F04D 9/06 415/206 |
| 6,113,362 | A | 9/2000 | Schmieder et al. | |
| 6,817,344 | B2 | 11/2004 | Dandan et al. | |
| 6,877,489 | B2 | 4/2005 | Hashimoto et al. | |

* cited by examiner

*Primary Examiner* — Kenneth J Hansen
(74) *Attorney, Agent, or Firm* — Baker Hostetler; John Wappel

(57) ABSTRACT

A pump includes a housing having an internal surface defining a volute configured to receive a pump impeller therein, an extension tube fluidly coupled to the volute, a wall of the extension tube having an internal surface disposed opposite an external surface, and a bonnet having an internal surface defining a first inlet aperture and a second inlet aperture therethrough, the first inlet aperture and the second inlet aperture being in fluid communication with the volute via the extension tube. The internal surface of the bonnet and the external surface of the extension tube define a bonnet flow path therebetween, the first inlet aperture of the bonnet being in fluid communication with the volute via the bonnet flow path.

13 Claims, 12 Drawing Sheets

RECIRCULATING PUMP INLET

TECHNICAL FIELD

This patent disclosure relates generally to fluid conditioning systems and, more particularly, to an inlet design for a pump.

Pumps are known for converting shaft power into fluid power. A pump impeller coupled to a source of shaft power may receive fluid from an inlet to the pump, perform work on the fluid, and discharge the fluid to an outlet of the pump. The pump inlet may receive fluid from a single source via a single conduit, or a plurality of sources via a plurality of conduits.

U.S. Pat. No. 5,100,289 (hereinafter "the '289 patent"), titled "Self-Priming Centrifugal Pump," purports to describe a self-priming centrifugal pump that combines two fluid streams in an inlet to the pump. The pump in the '289 patent includes a stator case with a delivery port and an outflow port and a radial-centrifugal bladed impeller. An ejector is provided inside the case and has an induction chamber which is connected to the intake port, an entrainment nozzle connected to the internal chamber of the stator case and a diffusion duct which is coaxial to the impeller and is connected to its inflow section. However, coaxial alignment of the entrainment nozzle, which receives flow from the outlet of the impeller, and the diffusion duct, as described in the '289 patent, may not suit the needs of other applications that combine fluid streams at a pump inlet.

Accordingly, there is a need for improved pump inlet structures to address the aforementioned concerns and/or other problems in the art.

It will be appreciated that this background description has been created to aid the reader, and is not to be taken as a concession that any of the indicated problems were themselves known in the art.

SUMMARY

According to an aspect of the disclosure, a pump comprises a housing having an internal surface defining a volute configured to receive a pump impeller therein; an extension tube fluidly coupled to the volute, a wall of the extension tube having an internal surface disposed opposite an external surface; and a bonnet having an internal surface defining a first inlet aperture and a second inlet aperture therethrough, the first inlet aperture and the second inlet aperture being in fluid communication with the volute via the extension tube. The internal surface of the bonnet and the external surface of the extension tube define a bonnet flow path therebetween, the first inlet aperture of the bonnet being in fluid communication with the volute via the bonnet flow path.

According to another aspect of the disclosure, a fluid system comprises a pump having an inlet and an outlet; an extension tube fluidly coupled to the inlet of the pump, a wall of the extension tube having an internal surface disposed opposite an external surface; and a bonnet having an internal surface defining a first inlet aperture and a second inlet aperture therethrough, the first inlet aperture and the second inlet aperture being in fluid communication with the inlet of the pump via the extension tube. The internal surface of the bonnet and the external surface of the extension tube define a bonnet flow path therebetween, the outlet of the pump being in fluid communication with the inlet of the pump via the first inlet aperture and the bonnet flow path.

Another aspect of the disclosure provides a method for operating a fluid system. The fluid system includes a pump having an inlet and an outlet; an extension tube fluidly coupled to the inlet of the pump, a wall of the extension tube having an internal surface disposed opposite an external surface, and a bonnet having an internal surface defining a first inlet aperture and a second inlet aperture therethrough. The internal surface of the bonnet and the external surface of the extension tube define a bonnet flow path therebetween. The method comprises flowing a first fluid from the outlet of the pump to the inlet of the pump via the first inlet aperture and the bonnet flow path; flowing a second fluid from a reservoir to the inlet of the pump via the second inlet aperture; and combining the first fluid with the second fluid upstream of the inlet of the pump.

DETAILED DESCRIPTION

Aspects of the disclosure will now be described in detail with reference to the drawings, wherein like reference numbers refer to like elements throughout, unless specified otherwise.

Figure 1:
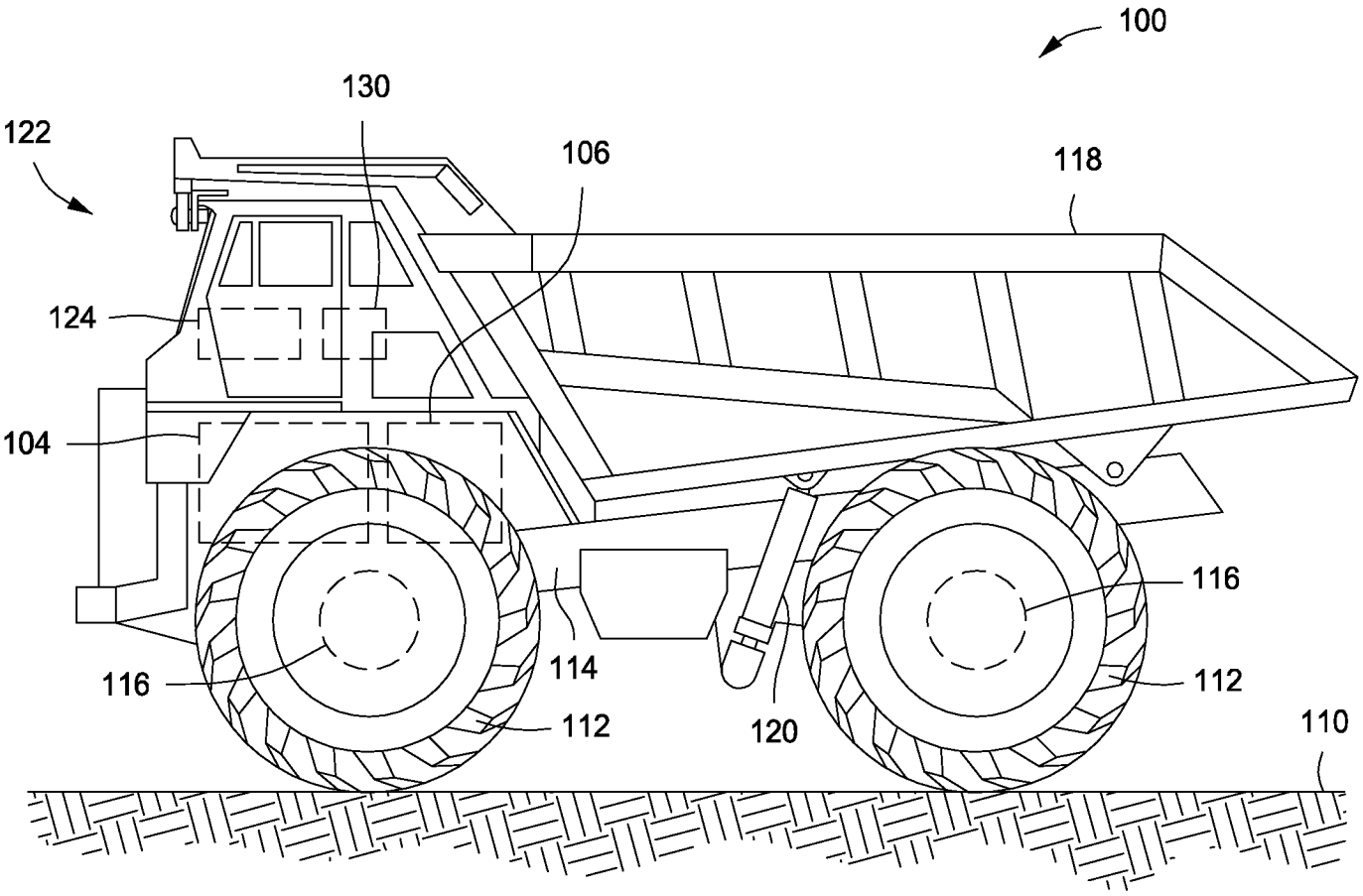
FIG. 1 shows a side view of a machine, according to an aspect of the disclosure.

FIG. 1 shows a side view of a machine 100, according to an aspect of the disclosure. The machine 100 includes an internal combustion (IC) engine 104 that is fluidly coupled to a fuel supply system 106. The IC engine 104 maybe a reciprocating internal combustion engine, such as a compression ignition engine or a spark ignition engine, for example, or a rotating internal combustion engine, such as a gas turbine, for example.

The machine 100 may be propelled over a work surface 110 by wheels 112 coupled to a chassis 114. The wheels 112 may be driven by motors 116, a mechanical transmission coupled to the IC engine 104, or combinations thereof. It will be appreciated that the machine 100 could also be propelled by tracks (not shown), combinations of wheels 112 and tracks, or any other surface propulsion device known in the art. Alternatively, the machine 100 could be a stationary machine, and therefore may not include a propulsion device.

The machine 100 may also include a work implement 118 driven by an actuator 120. The work implement 118 could be a dump bed, a shovel, a drill, a fork lift, a feller-buncher, a conveyor, or any other implement known in the art for performing work on a load. The actuator 120 may be a hydraulic actuator, such as a linear hydraulic motor or a rotary hydraulic motor, an electric motor, a pneumatic actuator, or any other actuator known in the art.

The machine 100 may include a cab 122 configured to accommodate an operator, and have a user interface 124 including using input devices for asserting control over the machine 100. The user interface 124 may include pedals, wheels, joysticks, buttons, touch screens, combinations thereof, or any other user input device known in the art. Alternatively or additionally, the user interface 124 may include provisions for receiving control inputs remotely from the cab 122, including wired or wireless telemetry, for example. The IC engine 104, the fuel supply system 106, and the user interface 124 may be operatively coupled to one another via a machine controller 130.

The machine 100 can be an "over-the-road" vehicle such as a truck used in transportation or may be any other type of machine that performs some type of operation associated with an industry such as mining, construction, farming, transportation, or any other industry known in the art. For example, the machine 100 may be an off-highway truck; an earth-moving machine, such as a wheel loader, an excavator, a dump truck, a backhoe, a motor grader, or a material handler; a marine vehicle or machine; a locomotive; or any other machine known in the art. The term "machine" can also refer to stationary equipment, such as a generator that is driven by an internal combustion engine to generate electricity. The specific machine 100 illustrated in FIG. 1 is a dump truck having a dump bed 118 that is actuated by a linear hydraulic cylinder 120.

Figure 2:
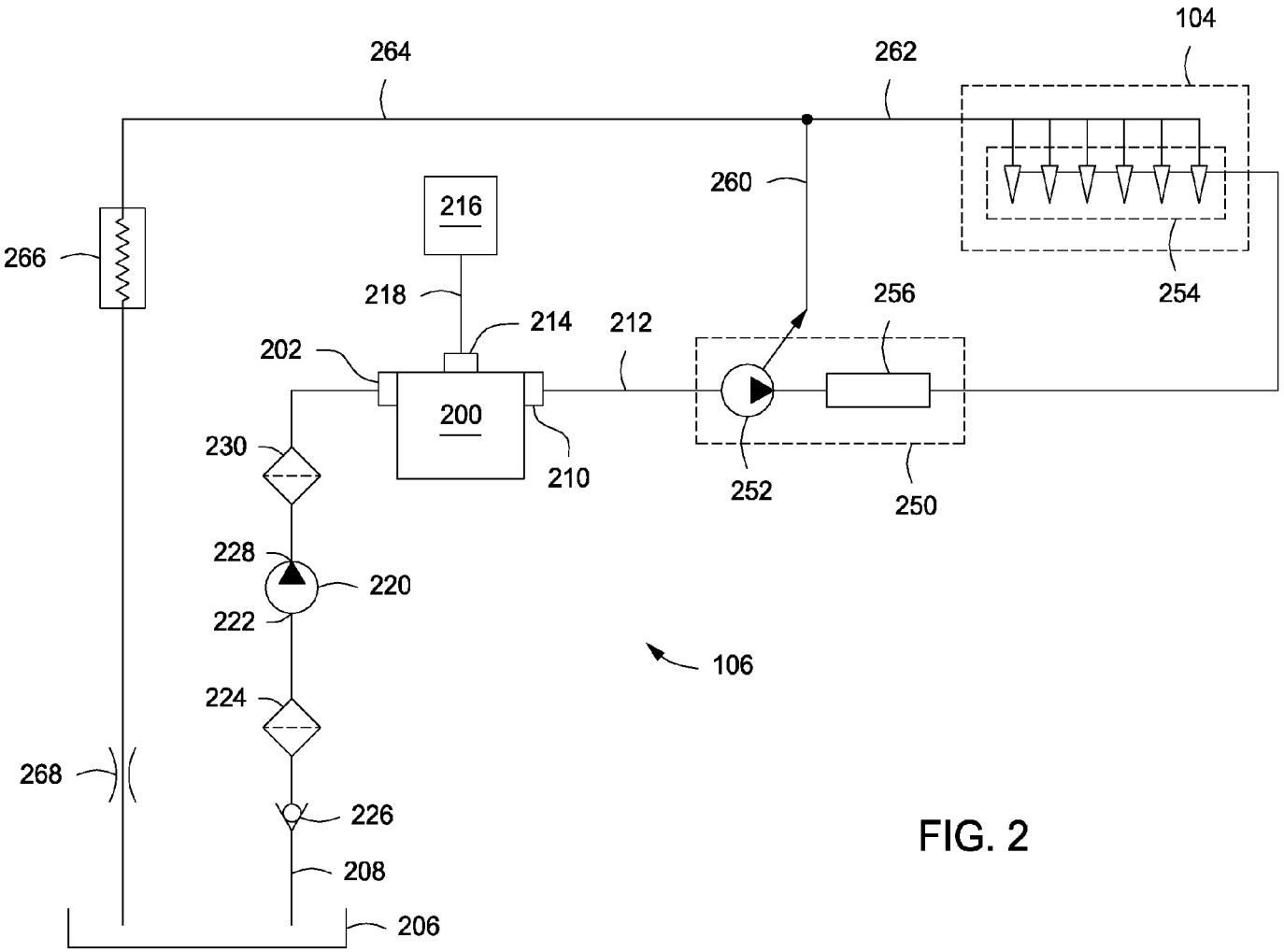
FIG. 2 shows a schematic view of a fuel supply system, according to an aspect of the disclosure.

FIG. 2 shows a schematic view of a fuel supply system 106, according to an aspect of the disclosure. The fuel supply system 106 includes a fluid conditioning module 200 having an inlet port 202 that is in fluid communication with a fuel reservoir 206 via a fuel suction conduit 208. An outlet port 210 of the fluid conditioning module 200 may be in fluid communication with the IC engine 104 via a module outlet conduit 212. The fluid conditioning module 200 may include pumps, valves, filters, sensors, heaters, coolers, controllers, combinations thereof, or any other structures known in the art to be beneficial for conditioning a fluid.

A power port 214 of the fluid conditioning module 200 is operatively coupled to a power source 216 via a power conduit 218. The power source 216 may be an electrical power source, a hydraulic power source, a pneumatic power source, a shaft power source, combinations thereof, or any other power source known in the art. The power conduit 218 may include an electrical conductor, a fluid conduit, a shaft, or any other means for transmitting power known in the art. According to an aspect of the disclosure, the power source 216 is an electrical power source, and the power conduit 218 consists of one or more electrical conductors.

The fluid conditioning module 200 may be fluidly coupled to the fuel reservoir 206 via a low-pressure transfer pump 220, which takes suction from the fuel reservoir 206 via the fuel suction conduit 208. Alternatively, the fluid conditioning module 200 includes a pump, and the fuel reservoir 206 may provide sufficient net positive suction head to the fluid conditioning module 200 such that the low-pressure transfer pump 220 is not necessary, and is therefore not included in the fuel supply system 106.

An inlet 222 of the low-pressure transfer pump 220 may be fluidly coupled to the fuel reservoir 206 via a filter or strainer 224, a check valve 226, or both. Alternatively or additionally, an outlet 228 of the low-pressure transfer pump 220 may be fluidly coupled to the inlet port 202 of the fluid conditioning module 200 via a filter or strainer 230. Further, it will be appreciated that the inlet port 202 of the fluid conditioning module 200 may be fluidly coupled to the fuel reservoir 206 via the filter or strainer 224, the check valve 226, or both, independent of whether the fuel supply system 106 includes the low-pressure transfer pump 220. The check valve 226 is configured to allow flow through the suction conduit 208 only in a direction from the fuel reservoir 206 toward the fluid conditioning module 200.

According to the aspect illustrated in FIG. 2, the outlet port 210 of the fluid conditioning module 200 is fluidly coupled to the IC engine 104 via a high-pressure pump system 250, which includes a high-pressure pump 252. The high-pressure pump 252 may be a high-pressure unit pump that is coupled to a single fuel injector of the IC engine 104, or a high-pressure common rail pump that is fluidly coupled to two or more fuel injectors 254 of the IC engine 104 via a common rail 256. Therefore, according to an aspect of the disclosure, the fluid conditioning module 200 is in fluid communication with the IC engine 104 via at least one pump disposed downstream of the outlet port 210 of the fluid conditioning module 200 along a direction of fuel flow through the module outlet conduit 212.

The fuel reservoir 206 may be in fluid communication with a pump drain conduit 260, a fuel injector drain conduit 262, or both, via a return conduit 264. The return conduit 264 may optionally include a heat exchanger 266 that is configured to transfer heat away from a flow of fuel through the return conduit 264. Further, the return conduit 264 may include an air bleed device 268 for separating gases from liquid fuel flowing through the return conduit 264 upstream of the fuel reservoir 206. The fuel reservoir 206 may be a liquid fuel reservoir that supplies one or more liquid fuels to the IC engine 104, such as, distillate diesel, biodiesel, dimethyl ether, seed oils, ethanol, methanol, combinations thereof, or any other combustible liquid known in the art.

Although the fluid conditioning module 200 is shown in the context of a fuel supply system 106 in FIG. 2, it will be appreciated that the fluid conditioning module 200 could be used to condition other fluids, such as, hydraulic fluid, coolant, water, lubricating oil, combinations thereof, or any other fluid known in the art. Unless specified otherwise, the term "fluid" is used herein to describe gases, liquids, slurries, combinations thereof, or other similar matter that tends to flow in response to applied sheer stress.

Figure 3:
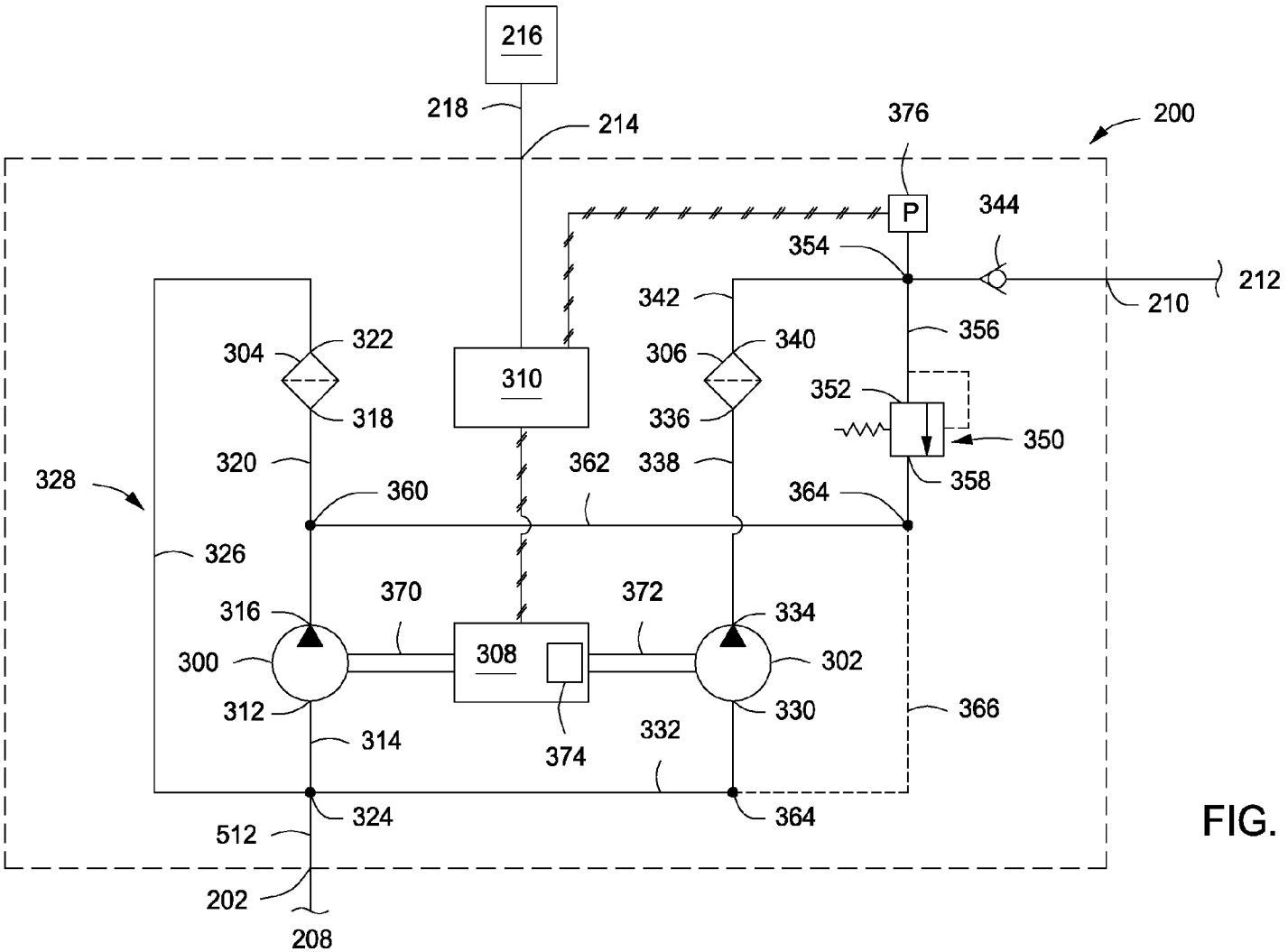
FIG. 3 shows a schematic view of a fluid conditioning module, according to an aspect of the disclosure.

FIG. 3 shows a schematic view of a fluid conditioning module 200, according to an aspect of the disclosure. The fluid conditioning module 200 includes a first pump 300, a second pump 302, a first filter 304, a second filter 306, a motor 308, and a module controller 310.

An inlet 312 to the first pump 300 is fluidly coupled to the inlet port 202 of the fluid conditioning module 200, and therefore the fuel suction conduit 208, via a first pump inlet conduit 314. An outlet 316 from the first pump 300 is fluidly coupled to an inlet port 318 of the first filter 304 via a first filter inlet conduit 320. An outlet port 322 of the first filter 304 is fluidly coupled to the first pump inlet conduit 314 at a node 324 via a first filter outlet conduit 326. Accordingly, the first filter inlet conduit 320, the first filter outlet conduit 326, and the first pump inlet conduit 314 form a fluid recirculation loop 328 about the first pump 300, which includes the first filter 304.

An inlet 330 to the second pump 302 is fluidly coupled to the node 324 via a second pump inlet conduit 332. In turn, the inlet 330 of the second pump 302 is fluidly coupled to the first filter outlet conduit 326 and the inlet port 202 of the fluid conditioning module 200 via the second pump inlet conduit 332. According to an aspect of the disclosure, the first pump 300 may be a turbomachine, such as, for example, a centrifugal pump. According to another aspect of the disclosure, the second pump 302 may have a positive displacement design, such as, for example a gerotor or external gear pump construction. However, it will be appreciated that either the first pump 300 or the second pump 302 may be a turbomachine, a positive displacement pump, or any other pump known in the art, to satisfy the needs of a particular application.

An outlet 334 from the second pump 302 is fluidly coupled to an inlet port 336 of the second filter 306 via a second filter inlet conduit 338. An outlet port 340 of the second filter 306 is fluidly coupled to the outlet port 210 of the fluid conditioning module 200 via a second filter outlet conduit 342. The second filter outlet conduit 342 may include a check valve 344 that is configured to allow flow only in a direction from the second filter 306 toward the outlet port 210 of the fluid conditioning module 200.

The fluid conditioning module 200 may include a pressure regulating valve 350 having an inlet 352 that is fluidly coupled to the second filter outlet conduit 342 at a node 354 via a regulating valve inlet conduit 356. Although FIG. 2 shows the node 354 located upstream of the check valve 344, it will be appreciated that the node 354 could be located anywhere along the second filter inlet conduit 338 and the second filter outlet conduit 342.

An outlet 358 of the pressure regulating valve 350 is fluidly coupled to the first filter inlet conduit 320 at a node 360 via a first drain conduit 362. Accordingly, the outlet 358 of the pressure regulating valve 350 is fluidly coupled to the inlet port 318 of the first filter 304 via the first drain conduit 362. Alternatively or additionally, the outlet 358 of the pressure regulating valve 350 may be fluidly coupled to the second pump inlet conduit 332 at a node 364 via a second drain conduit 366. In turn, the outlet 358 of the pressure regulating valve 350 may be in fluid communication with the inlet 312 to the first pump 300 and the inlet to the second pump 302 via the second drain conduit 366.

The pressure regulating valve 350 has a first configuration that blocks fluid communication between the inlet 352 and the outlet 358 of the pressure regulating valve 350, and a second configuration that effects fluid communication between the inlet 352 and the outlet 358 of the pressure regulating valve 350. Further, the pressure regulating valve 350 may actuate between its first configuration and its second configuration based on a difference between the pressure at the inlet 352 and a predetermined threshold value. According to an aspect of the disclosure, the pressure regulating valve 350 may toggle from its first configuration to its second configuration when the pressure at the inlet 352 exceeds a predetermined threshold value. According to another aspect of the disclosure, the pressure regulating valve 350 may operate proportionally between its first configuration and a wide open position based on a difference between the pressure at the inlet 352 and a predetermined threshold value.

The first pump 300 is operatively coupled to the motor 308 via a first shaft 370 for transmission of shaft power therebetween, and the second pump 302 is operatively coupled to the motor 308 via a second shaft 372 for transmission of shaft power therebetween. The motor 308 may be powered by electrical power, hydraulic power, pneumatic power, combinations thereof, or any other motor power source known in the art.

According to an aspect of the disclosure, the motor 308 is configured to drive the first shaft 370 at the same angular velocity as the second shaft 372. According to another aspect of the disclosure, the motor 308 may include gearing 374 operatively coupled to the first shaft 370, the second shaft 372, or both, such that an angular velocity for the first shaft 370 is different from the angular velocity of the second shaft 372 according to a prescribed relationship as a function of the angular velocity of the motor 308.

The motor 308 is operatively coupled to the module controller 310 for control thereof, and the module controller 310 is operatively coupled to the power source 216 at the power port 214 via the power conduit 218, as described previously. The fluid conditioning module 200 may include a pressure sensor 376 that is in fluid communication with the second filter outlet conduit 342, and operatively coupled to the module controller 310 for transmission of data signals, power, or both, therebetween. Accordingly, the module controller 310 may exchange data signals, power transmission, or both, with the motor 308 or the pressure sensor 376.

According to an aspect of the disclosure, the motor 308 is a variable speed motor and the module controller 310 is configured to vary a rotational speed of the motor 308. Further, the module controller 310 may be configured to vary a speed of the motor 308 based on a comparison between a pressure signal from the pressure sensor 376 and a predetermined threshold value. According to another aspect of the disclosure, the motor 308 is a constant speed motor, and the module controller 310 is configured to actuate the motor 308 between a stopped condition and a fixed-speed condition.

The module controller 310 may be any purpose-built processor for effecting control of the fluid conditioning module 200. It will be appreciated that the module controller 310 may be embodied in a single housing, or a plurality of housings distributed throughout the fluid conditioning module 200. Further, the module controller 310 may include power electronics, preprogrammed logic circuits, data processing circuits, volatile memory, non-volatile memory, software, firmware, input/output processing circuits, combinations thereof, or any other controller structures known in the art.

Figure 4:
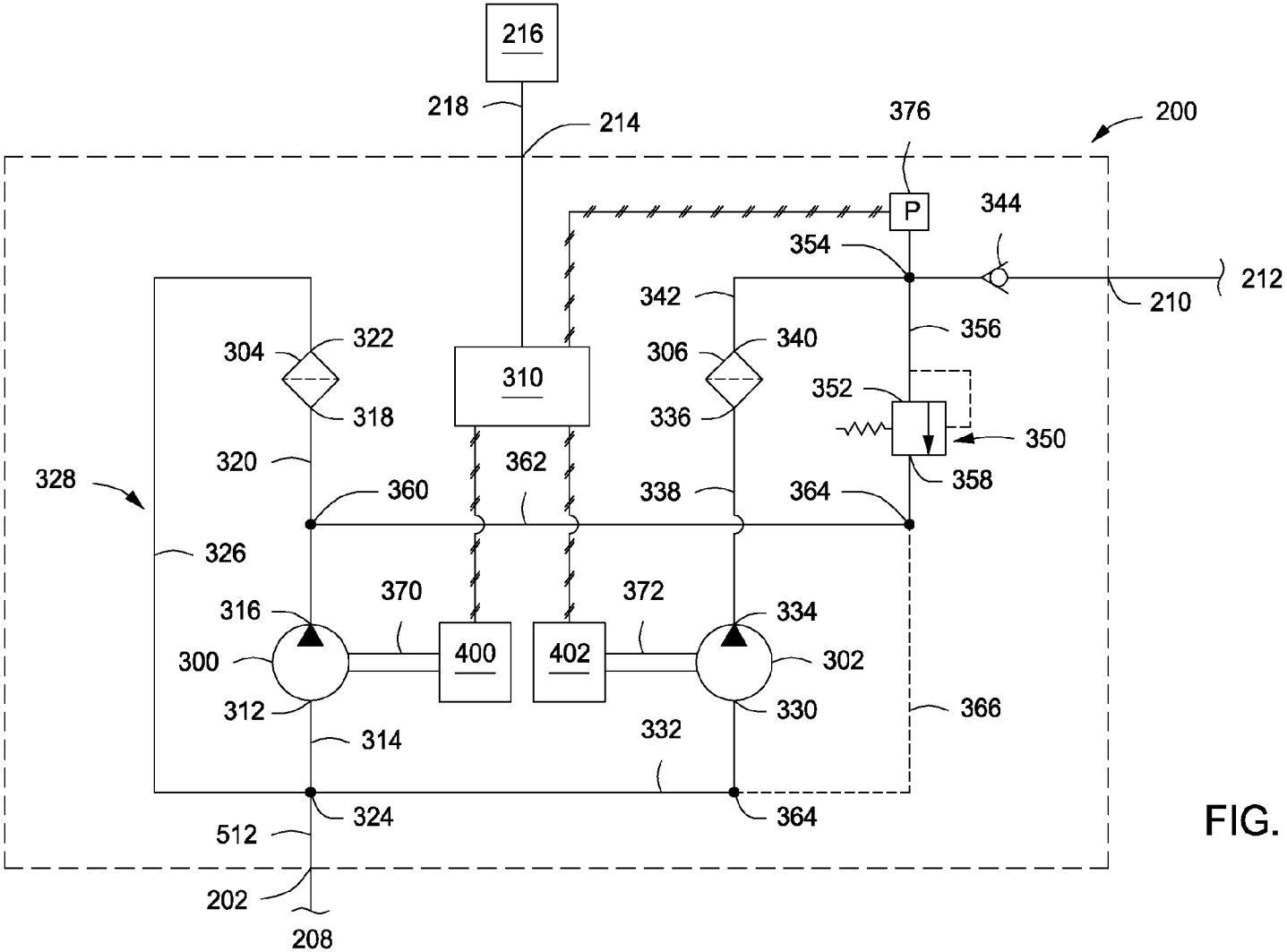
FIG. 4 shows a schematic view of a fluid conditioning module, according to an aspect of the disclosure.

FIG. 4 shows a schematic view of a fluid conditioning module 200, according to an aspect of the disclosure. Similar to FIG. 3, the fluid conditioning module 200 in FIG. 4 includes the first pump 300, the second pump 302, the first filter 304, the second filter 306, and the module controller 310. However, the fluid conditioning module 200 in FIG. 4 further includes a first motor 400 operatively coupled to the first pump 300 via the first shaft 370, and a second motor 402 operatively coupled to the second pump 302 via the second shaft 372. The first motor 400 and the second motor 402 may each be operatively coupled to the module controller 310 for control thereof. Either of the first motor 400 or the second motor 402 may be powered by electrical power, hydraulic power, pneumatic power, or any other motor power source known in the art. According to an aspect of the disclosure, the first shaft 370 is free from any mechanical coupling with the second shaft 372 that would prohibit rotation of the first shaft 370 independent of rotation with the second shaft 372.

The first motor 400 and the second motor 402 may embody various combinations of fixed-speed and variable-speed characteristics as outlined below. According to an aspect of the disclosure, both the first motor 400 and the second motor 402 are variable speed motors, and the module controller 310 is configured to operate each of the first motor 400 and the second motor 402 at speeds independent of one another. According to another aspect of the disclosure, the first motor 400 is a variable speed motor and the second motor 402 is a fixed speed motor, and the module controller 310 is configured to operate the first motor 400 at a speed that is independent of a speed of the second motor 402. According to another aspect of the disclosure, the first motor 400 is a fixed speed motor and the second motor 402 is a variable speed motor, and the module controller 310 is configured to operate the second motor 402 at a speed that is independent of a speed of the first motor 400.

According to another aspect of the disclosure, both the first motor 400 and the second motor 402 are fixed speed motors, and the controller is configured to operate the first motor 400 and the second motor 402 independent of one another. It will be appreciated that the first motor 400 may have a fixed operating speed that is the same as or different from a fixed operating speed of the second motor 402.

Figure 5:
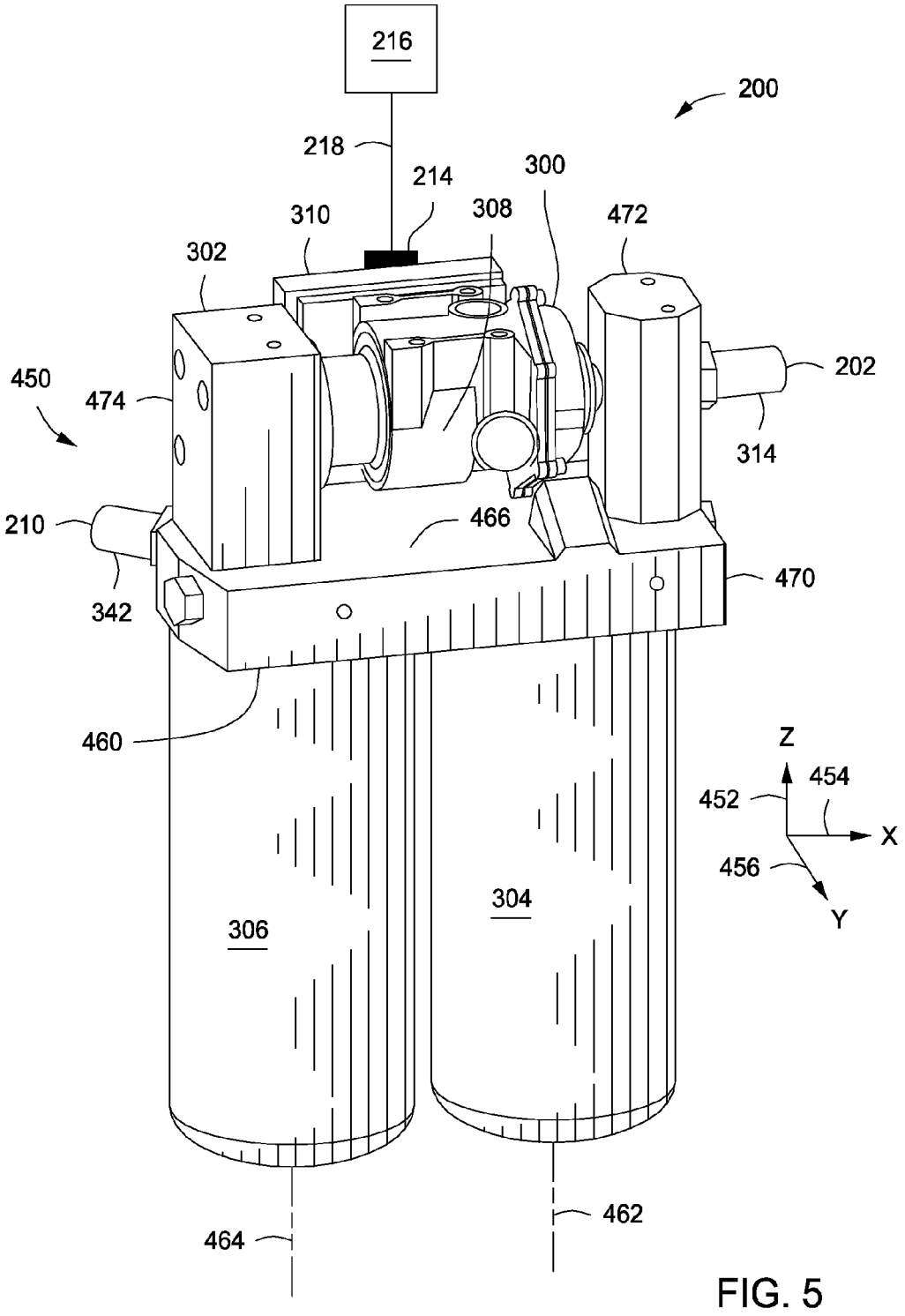
FIG. 5 shows a perspective view of a fluid conditioning module, according to an aspect of the disclosure.

FIG. 5 shows a perspective view of a fluid conditioning module 200, according to an aspect of the disclosure. The fluid conditioning module 200 may include a block 450 that functions to provide points of attachment for any of the components of the fluid conditioning module 200, to define fluid passages to effect fluid communication between components of the fluid conditioning module 200, or combinations thereof. It will be appreciated that the block 450 may be formed and consist of a single unitary part, or alternatively, the block 450 may include a plurality of parts fastened to one another by threaded fasteners, rivets, welding, brazing, interference fits, combinations thereof, or any other material fasteners or techniques known in the art.

In FIG. 5, a height or vertical direction 452 extends along the z-axis, a width direction 454 extends along the x-axis, and a depth direction 456 extends along the y-direction, where the x-axis, the y-axis, and the z-axis may all be mutually normal or perpendicular to one another.

The first filter 304 and the second filter 306 are each mounted to a lower surface 460 of the block 450. A longitudinal axis 462 of the first filter 304 and a longitudinal axis 464 of the second filter 306 may each extend away from the lower surface 460 of the block 450 along the height direction 452. The longitudinal axis 462 of the first filter 304 may be substantially parallel to the longitudinal axis 464 of the second filter 306. Further, the longitudinal axis 462 of the first filter 304 and the longitudinal axis 464 of the second filter 306 may each lie in a plane defined by the width direction 454 and the height direction 452.

The block 450 may define the inlet port 202, the outlet port 210, or both, of the fluid conditioning module 200. It will be appreciated that the block 450 may include fluid fittings coupled thereto, and that such fluid fittings may be said to part of the block 450 and define the inlet port 202, the outlet port 210, or both.

As shown in FIG. 5, the block 450 includes a first block portion 470, a second block portion 472 fastened to the upper surface 466 of the first block portion 470, and a third block portion 474 fastened to the upper surface 466 the first block portion 470. The second block portion 472 and the third block portion 474 each extend away from the upper surface 466 of the first block portion 470 along the height direction 452. Alternatively, it will be appreciated that combinations of the first block portion 470, the second block portion 472, and third block portion 474 may be machined, cast, or otherwise formed as a single unitary piece.

The second pump 302 may be disposed at least partly within the third block portion 474. According to an aspect of the disclosure, the second pump 302 is disposed completely within the third block portion 474, except for the second shaft 372, which may extend outside the third block portion 474 to the motor 308. As discussed below, each of the first block portion 470, the second block portion 472, and the third block portion 474 may define fluid passages therein, thereby effecting fluid communication between the various components of the fluid conditioning module 200.

The first pump 300, the second pump 302, and the motor 308 are shown fastened to an upper surface 466 of the first block portion 470, where the upper surface 466 of the block 450 is opposite the lower surface 460 of the block 450 along the height direction 452. The first pump 300, the second pump 302, and the motor 308 may be fastened to the block 450 by threaded fasteners, or any other fasteners known in the art. Although only one motor 308 is shown in FIG. 5, it will be appreciated that the motor 308 could be replaced by the first motor 400 and the second motor 402 shown schematically in FIG. 4, without changing the arrangement of the first pump 300, the first shaft 370, the second pump 302, and the second shaft 372 along the width direction 454.

The second block portion 472 and the third block portion 474 each extend away from the upper surface 466 of the first block portion 470 along the height direction 452. The second pump 302 may be disposed at least partly within the third block portion 474. According to an aspect of the disclosure, the second pump 302 is disposed completely within the third block portion 474, except for the second shaft 372, which extends outside the third block portion 474 to the motor 308.

The module controller 310 may be fastened to the motor 308, or otherwise fastened to the block 450, either directly or indirectly through another component. As discussed previously, the module controller 310 receives power from a power source 216 via a power conduit 218 coupled to the power port 214 of the fluid conditioning module 200.

Figure 6:
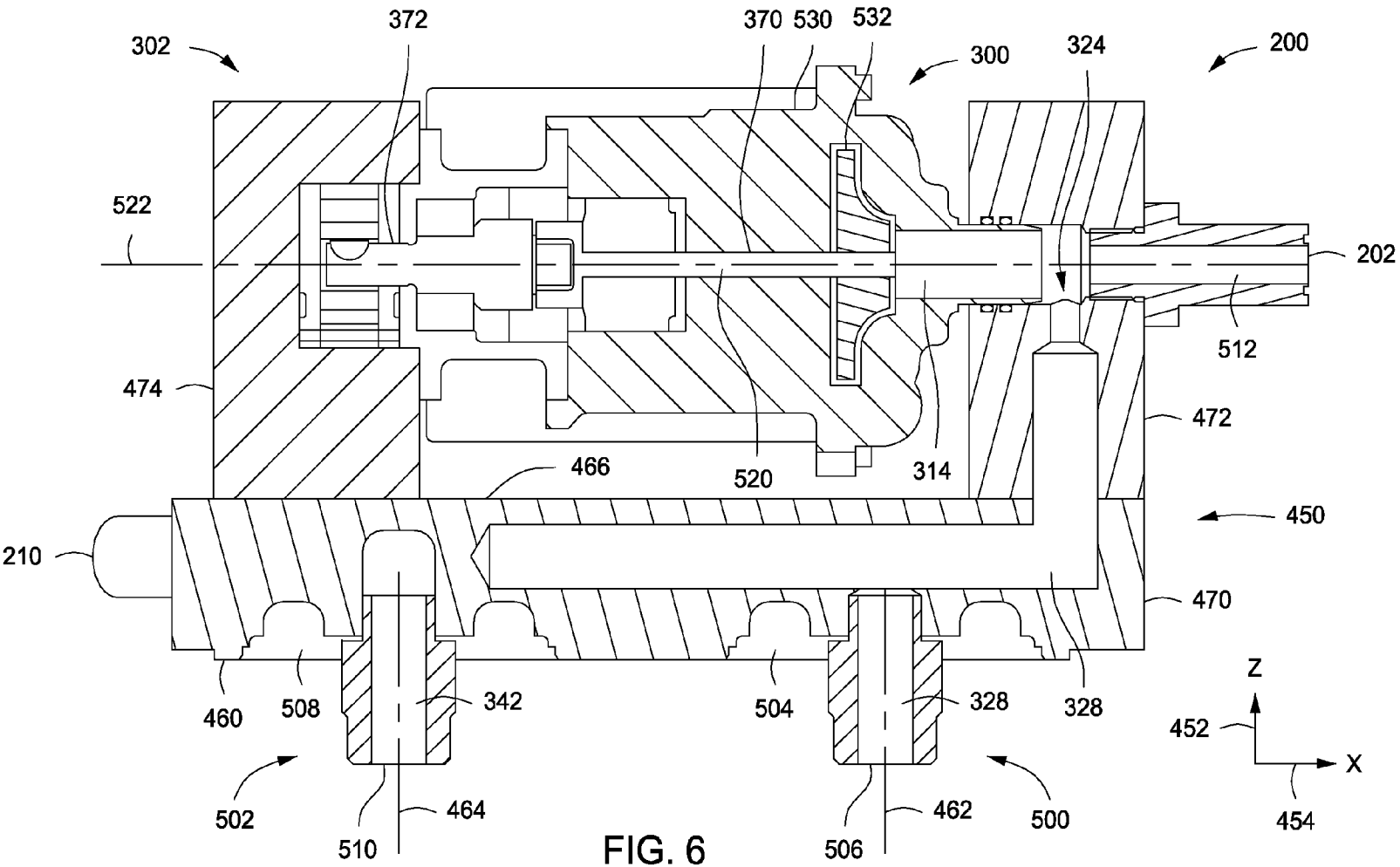
FIG. 6 shows a partial cross sectional view of the fluid conditioning module illustrated in FIG. 5, according to an aspect of the disclosure.
Figure 7:
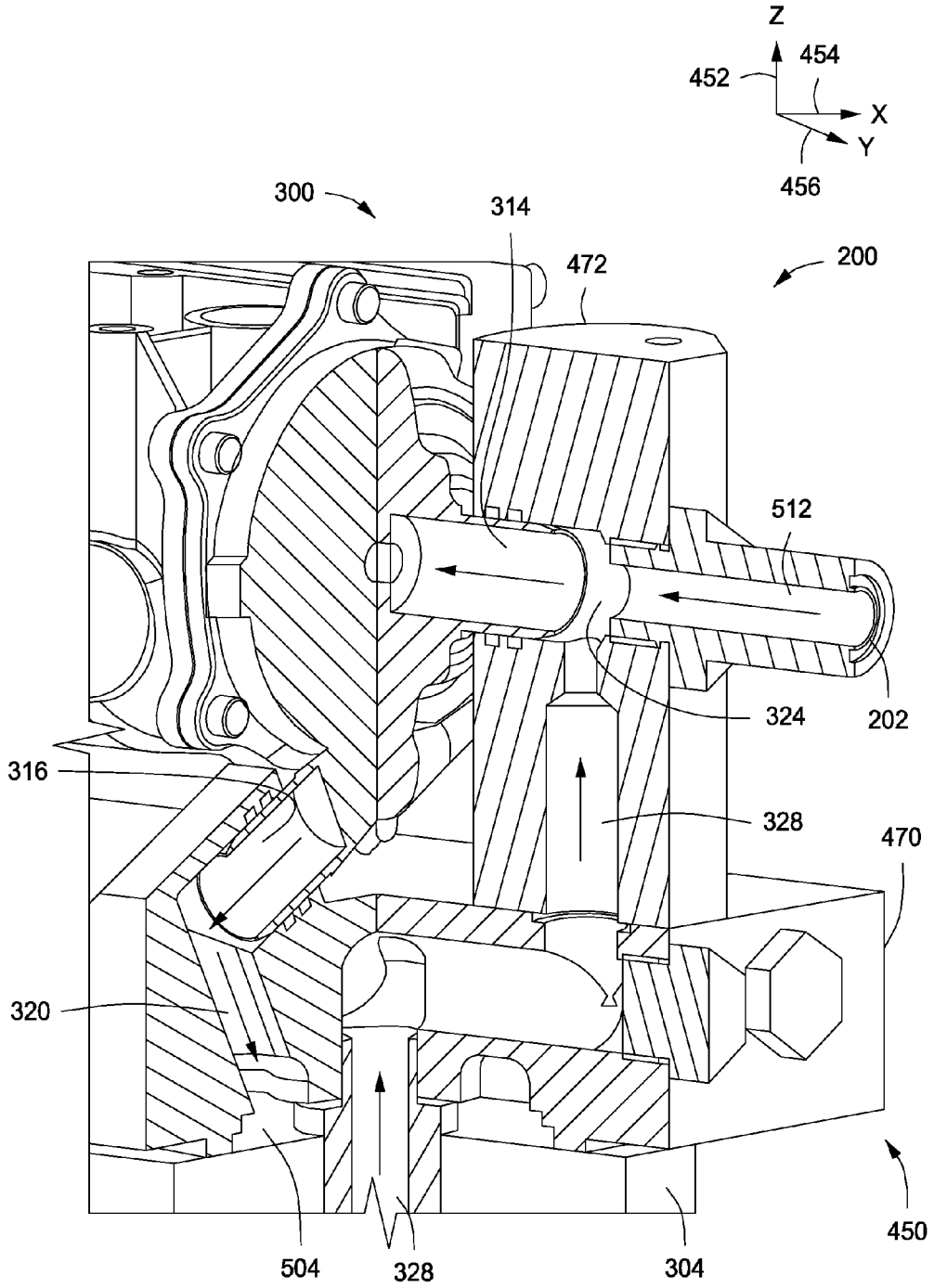
FIG. 7 shows a partial cross sectional view of the fluid conditioning module illustrated in FIG. 5, according to an aspect of the disclosure.
Figure 8:
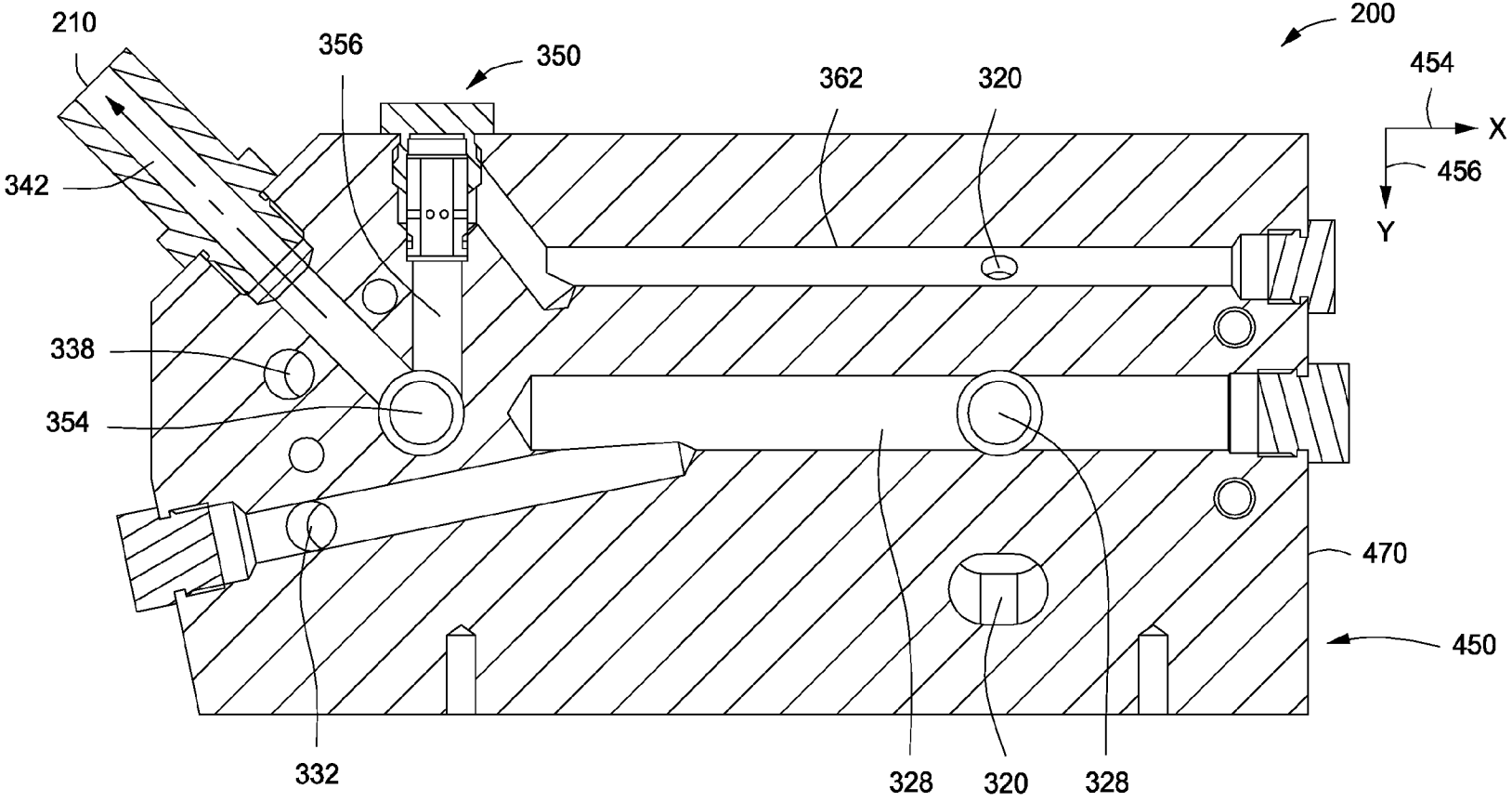
FIG. 8 shows a partial cross sectional view of the fluid conditioning module illustrated in FIG. 5, according to an aspect of the disclosure.

Referring now to FIGS. 6-8, FIG. 6 shows a partial cross sectional view of the fluid conditioning module 200 illustrated in FIG. 5, according to an aspect of the disclosure; FIG. 7 shows a partial cross sectional view of the fluid conditioning module 200 illustrated in FIG. 5, according to an aspect of the disclosure; and FIG. 8 shows a partial cross sectional view of the fluid conditioning module 200 shown in FIG. 5, according to an aspect of the disclosure.

In FIG. 6, the fluid conditioning module 200 is shown without the first filter 304 and the second filter 306, to illustrate the a first filter mount 500 and a second filter mount 502, defined by the lower surface 460 of the block 450. The first filter mount 500 may define a first filter inlet aperture or port 504, which may effectively define a downstream terminal end of the first filter inlet conduit 320 (see FIG. 8), and may define a first filter outlet aperture or port 506, which may effectively define an upstream terminal end of the first filter outlet conduit 326. The second filter mount 502 may define a second filter inlet aperture or port 508, which may effectively define a downstream terminal end of the second filter inlet conduit 338 (see FIG. 3), and may define a second filter outlet aperture or port 510, which may effectively define an upstream terminal end of the second filter outlet conduit 342. The first filter mount 500 and the second filter mount 502 may also include filter fastening features, such as, for example, internal threads, external threads, clamps, or other filter fastening structures known in the art.

Each of the first block portion 470, the second block portion 472, and the third block portion 474 may define fluid passages therein, thereby effecting fluid communication between the various components of the fluid conditioning module 200. For example, as shown in FIGS. 6 and 7, the second block portion 472 may define the fluid node 324 therein, such that the second block portion 472 effects fluid communication between the first filter outlet conduit 326, the first pump inlet conduit 314, the second pump inlet conduit 332 (see FIG. 7), and a module inlet conduit 512. Further as shown in FIG. 8, the first block portion 470 may define the fluid node 354 therein, such that the first block portion 470 effects fluid communication between the second filter outlet conduit 342 and the first drain conduit 362 via the pressure regulating valve 350.

Referring to FIG. 6, a longitudinal axis 520 of the first shaft 370 may be substantially parallel with a longitudinal axis 522 of the second shaft 372. According to another aspect of the disclosure, the longitudinal axis 520 of the first shaft 370 may be substantially collinear with the longitudinal axis 522 of the second shaft 372. Further, each of the longitudinal axis 520 of the first shaft 370 and the longitudinal axis 522 of the second shaft 372 may be substantially aligned with the width direction 454.

According to an aspect of the disclosure, the first pump 300 is a recirculation pump that includes a centrifugal pump. According to another aspect of the disclosure, the centrifugal pump includes a housing 530 configured to receive an impeller 532 from a plurality of impellers, where each impeller 532 of the plurality of impellers effects a unique flow-versus-pressure rise characteristic when operating within the housing 530.

Figure 9:
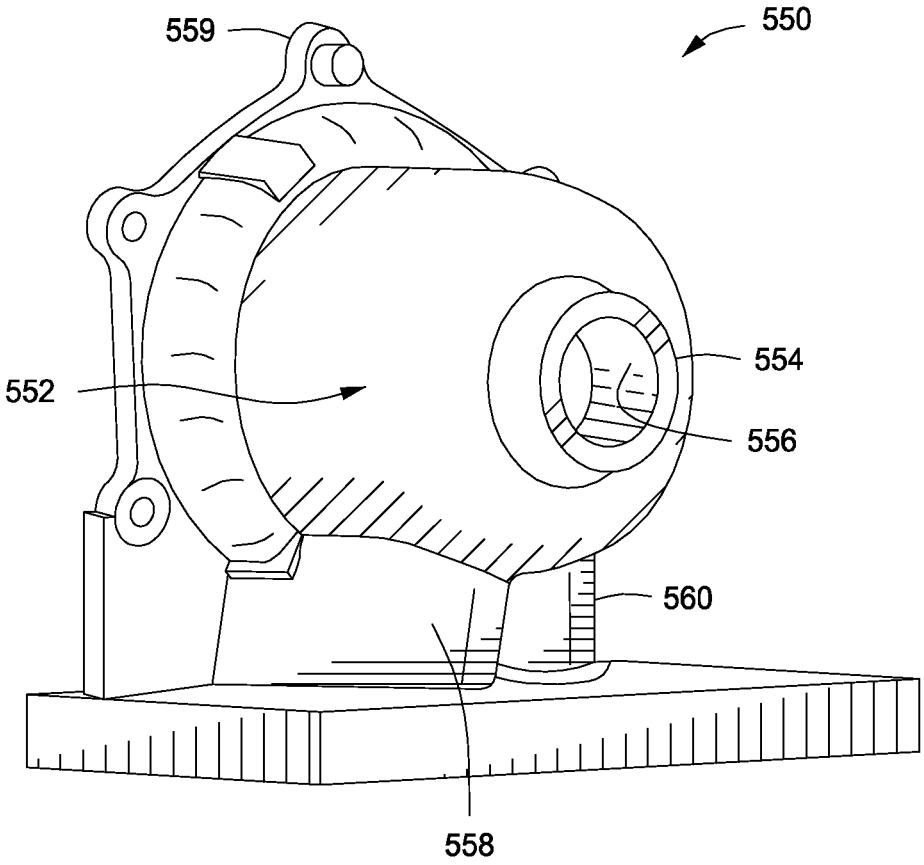
FIG. 9 shows a perspective view of a pump inlet structure, according to an aspect of the disclosure.

FIG. 9 shows a perspective view of a pump inlet structure 550, according to an aspect of the disclosure. The pump inlet structure 550 includes a bonnet 552, which may define a first inlet port 554 and a first inlet conduit 556, and may include portions that define a second inlet conduit 558 and a pump outlet conduit 560. According to an aspect of the disclosure, the pump inlet structure 550 may compose at least a portion of the second block portion 472 of the fluid conditioning module 200, as illustrated in FIGS. 5-7, for example. Further, the pump inlet structure 550 may include a flange 559 for removably attaching and sealing the pump inlet structure 550 against a housing 530 of a pump 300 (see FIG. 6).

According to another aspect of the disclosure, the first inlet conduit 556 may compose at least a portion of the module inlet conduit 512 (see FIG. 3) of the fluid conditioning module 200, and the second inlet conduit 558 may compose at least a portion of the first filter outlet conduit 326 (see FIG. 3) of the fluid conditioning module 200. However, it will be appreciated that the pump inlet structure 550 may benefit pump systems or assemblies other than those described for the fluid conditioning module 200.

Figure 10:
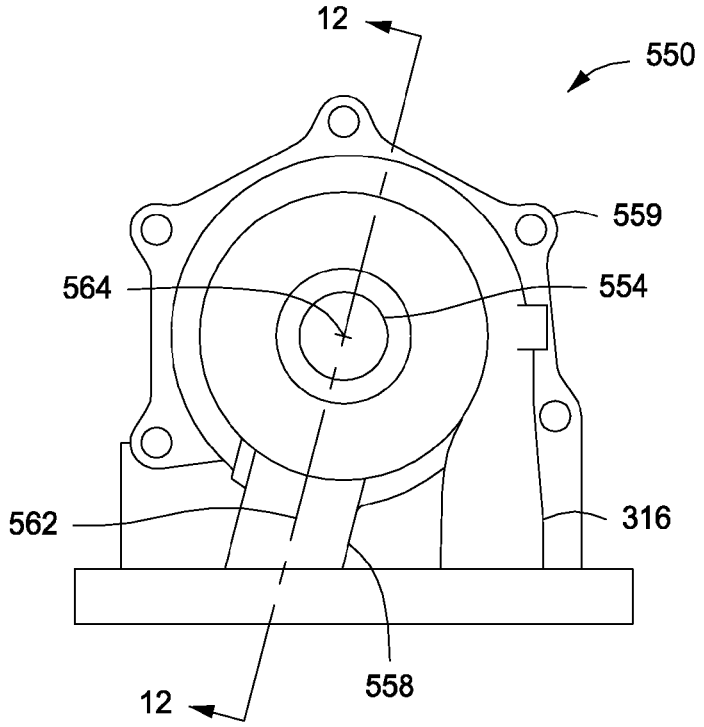
FIG. 10 shows an end view of a pump inlet structure, according to an aspect of the disclosure.

FIG. 10 shows an end view of a pump inlet structure 550, according to an aspect of the disclosure. In FIG. 10, section line 12-12 is defined by a plane passing through a longitudinal axis 562 of the second inlet conduit 558 and a center 564 of the first inlet port 554.

Figure 11:
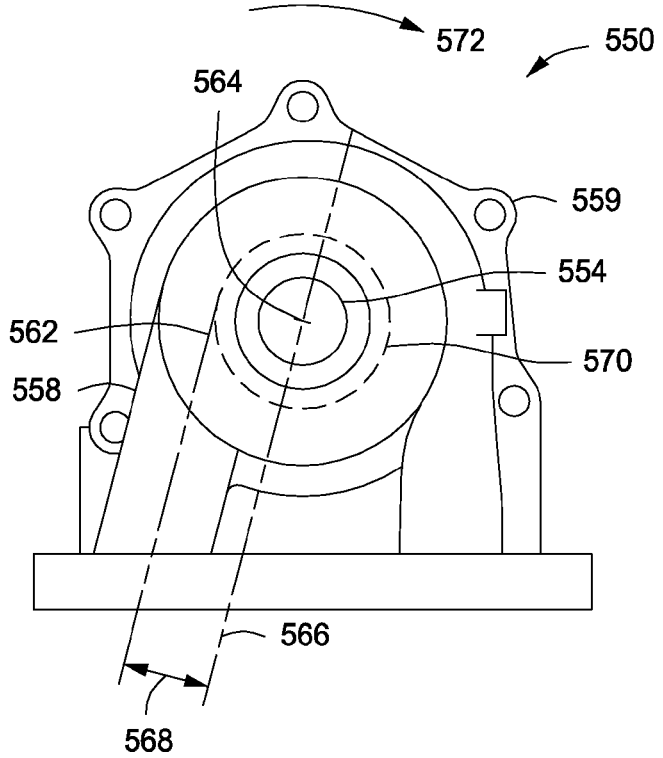
FIG. 11 shows an end view of a pump inlet structure, according to an aspect of the disclosure.

FIG. 11 shows an end view of a pump inlet structure 550, according to an aspect of the disclosure. In FIG. 11, the longitudinal axis 562 of the second inlet conduit 558 does not intersect the center 564 of the first inlet port 554. Instead, in FIG. 11, the longitudinal axis 562 of the second inlet conduit 558 is spaced apart from a line 566 intersecting the center 564 of the first inlet port 554 and extending parallel to the longitudinal axis 562 of the second inlet conduit 558 by a distance 568. In other words, the longitudinal axis 562 of the second inlet conduit 558 may be tangent to a circle 570 that is centered on the center 564 of the first inlet port 554. As a result, fluid flow entering the pump inlet structure 550 via the second inlet conduit 558 may carry a tangential velocity or swirl component into the corresponding pump about the circumferential direction 572.

Figure 12:
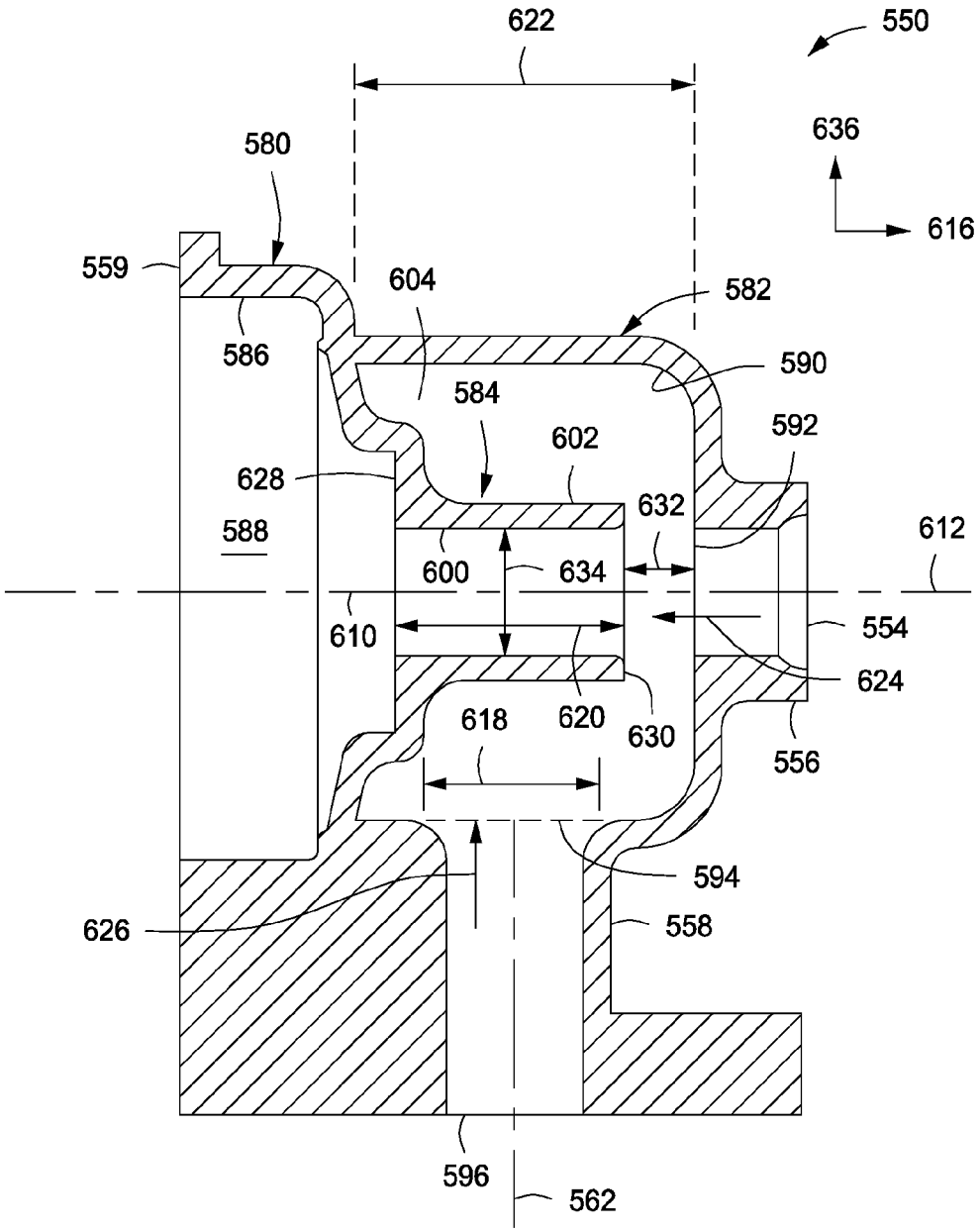
FIG. 12 shows a cross-sectional view of the pump inlet structure along section line 12-12, according to an aspect of the disclosure.

FIG. 12 is a cross-sectional view of the pump inlet structure 550 along section line 12-12, according to an aspect of the disclosure. The pump inlet structure 550 may include a housing 580, a bonnet 582, and an extension tube 584. The housing 580, the bonnet 582, and the extension tube 584 are shown in FIG. 12 as having a unitary or integrated structure. However, it will be appreciated that the pump inlet structure 550 may be assembled from a plurality of separate or distinct parts composing the housing 580, the bonnet 582, the extension tube 584, or combinations thereof.

The housing 580 includes an internal surface 586 that defines a volute 588, where the volute 588 is configured to receive a pump impeller 532 (see FIG. 6). According to an aspect of the disclosure, the housing 580 may compose at least a portion of the housing 530 shown in FIG. 6.

The bonnet 582 has an internal surface 590 that defines a first inlet aperture 592 and a second inlet aperture 594. The first inlet aperture 592 may be in fluid communication with the first inlet port 554 via the first inlet conduit 556, and the second inlet aperture 594 may be in fluid communication with a second inlet port 596 via the second inlet conduit 558. Further, the first inlet aperture 592 and the second inlet aperture 594 may be in fluid communication with the volute 588 via the extension tube 584.

The extension tube 584 includes a wall having an internal surface 600 disposed opposite an external surface 602. The external surface 602 of the extension tube 584 and the internal surface 590 of the bonnet 582 define a bonnet flow path 604 therebetween, such that the second inlet aperture 594 is in fluid communication with the volute 588 via the bonnet flow path 604. Further, the first inlet aperture 592 may also be in fluid communication with the volute 588 via the bonnet flow path 604.

The extension tube 584 may define a longitudinal axis 610 therein, and the first inlet conduit 556 may define a longitudinal axis 612 therein. According to an aspect of the disclosure, the longitudinal axis 610 of the extension tube 584 is substantially parallel to the longitudinal axis 612 of the first inlet conduit 556. According to another aspect of the disclosure, the longitudinal axis 610 of the extension tube 584 is substantially collinear with the longitudinal axis 612 of the first inlet conduit 556. According to another aspect of the disclosure, a longitudinal axis 614 of the second inlet conduit 558 is substantially perpendicular to the longitudinal axis 610 of the extension tube 584. As used herein, "substantially parallel" may mean within five angular degrees of parallel, and "substantially perpendicular" may mean within five angular degrees of perpendicular.

A longitudinal direction 616 may be defined parallel to the longitudinal axis 610 of the extension tube 584, parallel to the longitudinal axis 612 of the first inlet conduit 556, or both. According to an aspect of the disclosure, a longitudinal extent 618 of the second inlet aperture 594 lies at least partly within a longitudinal extent 620 of the extension tube 584 along the longitudinal direction 616. According to another aspect of the disclosure, the longitudinal extent 618 of the second inlet aperture 594 lies entirely within the longitudinal extent 620 of the extension tube 584 along the longitudinal direction 616. According to another aspect of the disclosure, the longitudinal extent 620 of the extension tube 584 lies entirely within a longitudinal extent 622 of the internal surface 590 of the bonnet 582.

A vector 624 normal or perpendicular to the first inlet aperture 592 may be substantially parallel to the longitudinal direction 616. Additionally, the vector 624 may be substantially collinear with the longitudinal axis 612 of the first inlet conduit 556, the longitudinal axis 610 of the extension tube 584, or both. A vector 626 normal or perpendicular to the second inlet aperture 594 may be substantially perpendicular to the longitudinal direction 616.

A first end 628 of the extension tube 584 may be rigidly fixed to at least one of the housing 580 and the bonnet 582. Additionally, a second end 630 of the extension tube 584 may be free from connection to either the housing 580 or the bonnet 582 other than the rigid connection at the first end 628 of the extension tube 584. In other words, the extension tube 584 may be cantilevered from at least one of the housing 580 and the bonnet 582 via a rigid connection at the first end 628 of the extension tube 584. Alternatively or additionally, the extension tube 584 may extend at least partly in the longitudinal direction 616 from a rigid connection to at least one of the housing 580 and the bonnet 582 toward the first inlet aperture 592.

Accordingly, the external surface 602 of the extension tube 584 may be contiguous with the internal surface 600 of the extension tube 584 near the second end 630 of the extension tube 584; and the external surface 602 of the extension tube 584 may not be contiguous with the internal surface 600 of the extension tube 584 near the first end 628 of the extension tube 584. The second end 630 of the extension tube 584 may be a fluid inlet end of the extension tube 584, and the first end 628 of the extension tube 584 may be a fluid outlet end of the extension tube 584, along a flow direction from either the first inlet aperture 592 or the second inlet aperture 594 toward the volute 588.

The second end 630 of the extension tube 584 may be separated from the first inlet aperture 592 by a distance 632 along the longitudinal direction 616. According to an aspect of the disclosure, the distance 632 is less than an internal dimension 634 of the extension tube 584 along a radial direction 636, where the radial direction 636 is perpendicular to the longitudinal direction 616.

Figure 13:
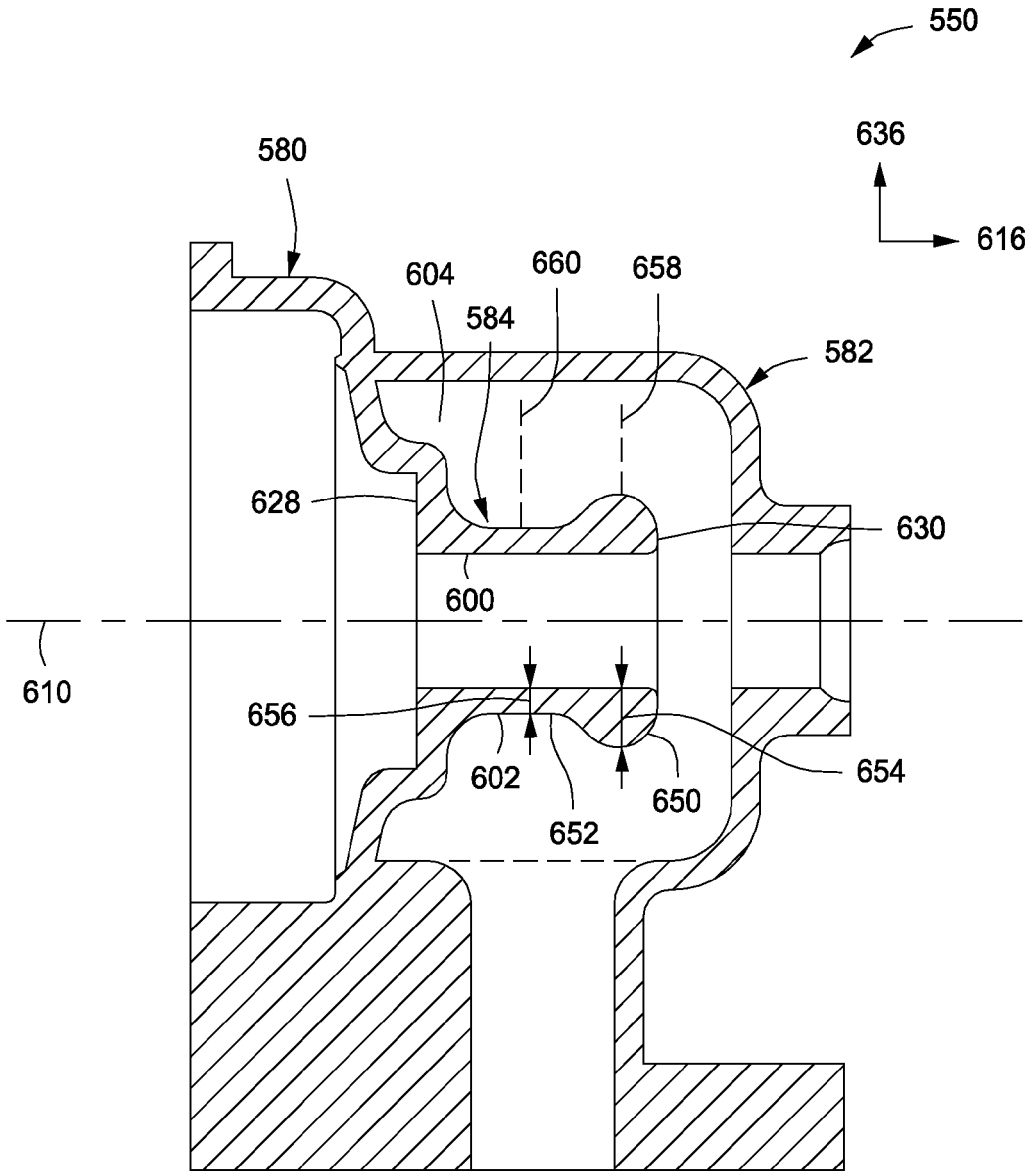
FIG. 13 shows a cross-sectional view of the pump inlet structure along section line 12-12, according to an aspect of the disclosure.

FIG. 13 is a cross-sectional view of the pump inlet structure 550 along section line 12-12, according to an aspect of the disclosure. Similar to FIG. 12, the pump inlet structure 550 in FIG. 13 may include a housing 580, a bonnet 582, and an extension tube 584, and may embody any of the features described with respect to FIG. 12. However, in addition, the external surface 602 of the extension tube 584 in FIG. 13 includes a convex portion 650 disposed near the second end 630 of the extension tube 584. A concavity of the convex portion 650 may face the radial direction 636 and extend along the longitudinal direction 616. The convex portion 650 may include a surface of revolution about the longitudinal axis 610 of the extension tube 584, and the surface of revolution may extend either partially or completely around the extension tube 584 along the circumferential direction 572 (see FIG. 11).

The external surface 602 of the extension tube 584 may also include a portion 652 disposed between the convex portion 650 and the first end 628 of the extension tube 584. According to an aspect of the disclosure, the portion 652 of the extension tube 584 is free from concavity along the longitudinal direction 616. According to another aspect of the disclosure, the portion 652 of the extension tube 584 has a cylindrical cross section in a plane normal to the longitudinal axis 610 of the extension tube 584.

A wall thickness 654 of the extension tube 584 at the convex portion 650 may be greater than a wall thickness 656 of the extension tube 584 at the portion 652. According to an aspect of the disclosure, the wall thickness 654 at the convex portion 650 may be at least twice as thick as the wall thickness 656 at the portion 652. Alternatively or additionally, an annular area of the bonnet flow path 604 at a radial plane 658 that intersects the convex portion 650 is less than an annular area of the bonnet flow path 604 at a radial plane 660 that intersects the portion 652 of the extension tube 584. Accordingly, fluid flow from the radial plane 660 toward the radial plane 658 may be accelerated by the constriction in the respective annular flow areas, before being turning by the bonnet flow path 604 toward the longitudinal axis 610 of the extension tube 584.

INDUSTRIAL APPLICABILITY

The present disclosure is applicable to fluid conditioning systems and, more particularly, to fuel conditioning modules for combustion engines.

Fuel injection pressures for direct injection compression ignition engines have increased over time at least partly in response to more stringent emissions regulations and incentives to improve fuel economy. And in response to this trend, Applicants have discovered that fuel injection system designs for higher injection pressures may exhibit higher sensitivity to fuel cleanliness, especially with respect to fuel-borne particulates. Further, the increased particulate sensitivity extends not only to the total volume fraction of particulates in the fuel, but also the maximum tolerable particle size. In turn, improved fuel filtration and conditioning systems can improve component service life through mitigation of surface wear and scuffing, heat-induced wear, or combinations thereof.

While conventional methods exist for improving filtration of fuel in a machine 100, Applicants recognized that the conventional methods tend to be bulky and expensive. As a result, Applicants have developed improvements to the conventional filtering methods within current design constraints for product packaging, cost, and maintainability, as described herein.

Referring to FIGS. 3 and 4, aspects of the disclosure provide a fluid conditioning module 200 including a first pump 300 operating in a fluid recirculation loop 328 with a first filter 304, in addition to a second pump 302 for delivering fuel from the fluid recirculation loop 328 to an engine 104 via a second filter 306. Applicants discovered that improved fuel filtering could be achieved within the aforementioned packaging, cost, and maintainability constraints by operating the first pump 300 a flow rate that is at least twice as high as the flow rate through the second pump 302. According to an aspect of the disclosure, the flow rate through the first pump 300 is greater than or equal to five times greater than the flow rate through the second pump 302.

As a result, a parcel of fuel entering the fluid conditioning module 200 from the fuel reservoir 206 will likely flow through the first filter 304 multiple times before advancing to the engine 104 via the second pump 302 and the second filter 306, thereby improving fuel quality with each successive pass through the first filter 304. While some conventional systems may effect so-called "kidney loop" operation with a separate system that recirculates fuel back to a fuel reservoir, Applicants discovered packaging and cost advantages by incorporating the fluid recirculation loop 328 into the fluid conditioning module 200 without recirculation to the fuel reservoir 206. Instead, the second pump 302 takes suction from the fluid node 324, which is in fluid communication with the outlet port 322 of the first filter 304. In turn, Applicants have identified improvements in fuel system component service life, especially for components operating downstream of a high-pressure common rail pump 252 (e.g., high-pressure common rail fuel injectors 254) within established limits for fuel system packaging size and cost.

Accordingly, during operation of the fluid conditioning module 200, a first flow of fuel enters the inlet 312 of the first pump 300. The first flow of fuel may have originated from the inlet port 202 to the fluid conditioning module 200, the fluid recirculation loop 328, the pressure regulating valve 350, or combinations thereof. The first pump 300 drives the first flow of fuel through the first filter 304 and back to the fluid node 324.

At node 324, the first flow of fuel may be split into a second flow of fuel that proceeds back to the inlet 312 of the first pump 300, and a third flow of fuel that proceeds to the inlet 330 of the second pump 302. According to an aspect of the disclosure, the second flow of fuel constitutes about 50-75% of the first flow of fuel, with the balance proceeding to the inlet 330 of the second pump 302.

Referring to FIGS. 12 and 13, the first inlet port 554 of the pump inlet structure 550 may be fluidly coupled to the module inlet conduit 512 (see FIG. 3) of the fluid conditioning module 200, and the second inlet port 596 may be fluidly coupled to the first filter outlet conduit 326 (see FIG. 3) such that the node 324 (see FIG. 3) lies within the pump inlet structure 550. Accordingly, the second inlet port 596 receives a flow of fluid from the outlet port 322 of the first filter 304, the first inlet port 554 receives a flow of fluid from the module inlet conduit 512, the two flows are combined within the pump inlet structure 550, and the combined flows are conveyed to the volute 588. Fluid flow through the second inlet conduit 558 may initially decelerate as it enters the bonnet flow path 604, and then accelerate as the fluid flow proceeds toward the second end 630 of the extension tube 584.

Fluid flow through the first inlet conduit 556 may combine with fluid flow from the second inlet conduit 558 at or near the second end 630 of the extension tube 584 without generating excessive turbulence, thereby promoting an advantageous fluid velocity profile entering the volute 588. Further, the flow entering through the first inlet conduit 556 may help to turn the flow entering through the second inlet conduit 558 toward the longitudinal direction 616 by imparting momentum to the fluid entering through the second inlet conduit 558 along the longitudinal direction 616. Accordingly, the pump inlet structure 550 may achieve combination of fluid flows at the inlet to a pump while reducing fluid power losses, and promote efficient operation of the pump by providing promoting an advantageous velocity profile entering the pump.

Improvements to filtration performance are further realized by pressurization of the fuel entering the first filter 304 by the first pump 300, which enables the use of finer filtration media in the first filter 304, the second filter 306, or both. For example, while some conventional approaches may only accommodate 10 μm filtration media within prescribed design constraints, aspects of the present disclosure enable use of finer 4 μm filtration media within the same design constraints; thereby further improving filtration performance and fuel quality. According to an aspect of the disclosure, the first filter 304 includes a single stage of 4 μm filtration media. According to another aspect of the disclosure, the first filter 304 includes a single stage of 4 μm filtration media, and the second filter 306 includes two stages of 4 μm filtration media arranged in series. According to another aspect of the disclosure, the two stages of 4 μm filtration media in the second filter 306 are arranged coaxially in series with one another. However, persons having skill in the art will appreciate that either the first filter 304 or the second filter 306 may include multiple filter elements in a single filter housing, multiple filter housings, or combinations thereof.

According to an aspect of the disclosure, the module controller 310 is configured to operate the first pump 300 with a discharge pressure at the outlet 316 up to about 18 psi (125 kPa). According to another aspect of the disclosure, the module controller 310 is configured to operate the second pump 302 with a discharge pressure at the outlet 334 of about 87 psi (600 kPa). Thus, it will be appreciated that the fluid conditioning module 200 does not include a high-pressure common rail pump capable of increasing fuel pressure to the final injection pressure. Instead, according to some aspects of the disclosure, the fluid conditioning module 200 performs a low-pressure transfer function to supply high-quality fuel to a high-pressure common rail pump 252.

The module controller 310 is configured to operate the first pump 300 at a flow rate that is higher than a flow rate of the second pump 302, and the module controller 310 may achieve this result in a number of ways depending upon the application.

Referring to FIG. 3, where both the first pump 300 and the second pump 302 are driven by a single motor 308, the first pump 300 may be selected to have a pumping characteristic such that, at the target pressure rise across the first pump 300, the flow rate through the first pump 300 is greater than the flow rate through the second pump 302, when the second pump 302 is also operated at its target pressure rise and the second pump 302 is operated at the same speed as the first pump 300. Accordingly, for the aforementioned pumping characteristics and same-speed operation of the first pump 300 and the second pump 302, the module controller 310 is configured to operate the first pump 300 at a higher flow rate than that of the second pump 302 by operating both the first pump 300 and the second pump 302 at the same speed.

Alternatively, as discussed above, the motor 308 may include gearing 374, such that the first pump 300 operates at a higher speed than the second pump 302 for any given operating speed of the motor 308. Accordingly, for the configuration where the first pump 300 and the second pump 302 have substantially the same pumping characteristic, operating the first pump 300 at a higher speed than the second pump 302, as a result of the gearing 374, the controller may be configured to operate the first pump 300 at a higher flow rate than that of the second pump 302 by operating the motor 308 at a given speed or range of speeds. Further, it will be appreciated that the gearing 374 may be combined with different pumping characteristics for the first pump 300 and the second pump 302 to achieve the desired relative flow rates between the first pump 300 and the second pump 302.

Referring now to FIG. 4, where the first pump 300 and the second pump 302 are operated independently by separate motors 400 and 402, respectively, it will be appreciated that the module controller 310 may be configured to tailor the flow rate of the first pump 300 relative to the flow rate of the second pump 302 by operating the first motor 400 and the second motor 402 at different speeds. As discussed previously, the first motor 400 and the second motor 402 may be variable speed motors, for example, and the module controller 310 may tailor the speeds of the first motor 400 and the second motor 402 to achieve the desired relative flow rates from the first pump 300 and the second pump 302.

Alternatively, if one of the first motor 400 and the second motor 402 were a variable speed motor and the other were a fixed speed motor, the module controller 310 could tailor the relative flow rates between the first pump 300 and the second pump 302 by varying the speed of the motor having variable speed capability. Further still, if the first motor 400 and the second motor 402 were each fixed speed motors, then the fixed speeds of the two motors could be selected in combination with the pumping characteristics of the first pump 300 and the second pump 302 to effect the desired relative flow rates between the first pump 300 and the second pump 302. Accordingly, the module controller 310 would be configured to operate the first pump 300 at a higher flow rate than the second pump 302 by operating the two fixed-speed motors 400, 402 at different respective fixed speeds.

The module controller 310 may be configured to monitor the operating speed of the motor 308, the first motor 400, the second motor 402, or combinations thereof, for purposes of identifying a filter loading level of the first filter 304, the second filter 306, or both. Further, the module controller 310 may be configured to monitor a signal from the pressure sensor 376 and compare the pressure signal to a prescribed threshold value. The signal from the pressure sensor 376 dropping below the prescribed threshold value may be indicative a high loading state of the first filter 304, the second filter 306, or both. In response to identifying a high loading state of filters within the fluid conditioning module 200, the module controller 310 may be configured to transmit a signal to the machine controller 130 or a display in the machine cab 122 informing an operator of the high filter loading condition within the fluid conditioning module 200.

Electrically driven pumps 300, 302 within the fluid conditioning module 200 may advantageously facilitate priming after filter service, as the engine 104 need not be running to drive the first pump 300, the second pump 302, or both, but instead use electrical energy stored in a battery to operate the fluid conditioning module 200. Similarly, electrically driven pumps 300, 302 may provide advantages with respect to starting the IC engine 104, because the electrically driven pumps 300, 302 do not require shaft power from the engine 104 to pressurize the high-pressure pump system 250 prior to starting the IC engine 104.

It will be appreciated that standardized, modular, and compact nature of the fluid conditioning module 200 facilitates application and installation engineering, particularly in light of only three connections between the machine 100 and the fluid conditioning module 200, namely: the inlet port 202, the outlet port 210, and the power port 214. Further, the compact and modular design of the fluid conditioning module 200 advantageously lends itself for mounting on a fuel tank or the chassis 114 of a machine 100, thereby avoiding the higher vibration environment of the IC engine 104. Applicants have discovered that vibration may diminish filtration performance through disruption of filter cake captured on filter media of the first filter 304 or the second filter 306.

Any of the methods or functions described herein may be performed by or controlled by the module controller 310. Further any of the methods or functions described herein may be embodied in a machine-readable non-transitory medium for causing the module controller 310 to perform the methods or functions described herein. Such machine-readable non-transitory media may include magnetic disks, optical discs, solid state disk drives, combinations thereof, or any other machine-readable non-transitory medium known in the art. Moreover, it will be appreciated that the methods and functions described herein may be incorporated into larger control schemes for the engine 104, the machine 100, or combinations thereof, including other methods and functions not described herein. Accordingly, the module controller 310 may be operatively coupled to the machine controller 130 for communication therewith, or at least partly embodied within the machine controller 130.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Unless specified otherwise, use of the word "substantially" herein means "considerable in . . . extent," or "largely but not necessarily wholly that which is specified."

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. A pump, comprising:

a housing having a volute configured to receive a pump impeller therein;

an extension tube fluidly coupled to the volute, a wall of the extension tube having an internal surface disposed opposite an external surface; and a bonnet having a second internal surface defining a first inlet aperture and a second inlet aperture therethrough, the first inlet aperture and the second inlet aperture being in fluid communication with the volute via the extension tube, the second internal surface of the bonnet and the external surface of the extension tube defining a bonnet flow path therebetween, the second inlet aperture of the bonnet being in fluid communication with the volute via the bonnet flow path, wherein the external surface of the extension tube is contiguous with the internal surface of the extension tube at an inlet end of the extension tube and includes a convex surface located near the inlet end of the extension tube, and a cylindrical surface disposed between the convex surface and the volute along a longitudinal axis of the extension tube, wherein a thickness of the wall at the convex surface is greater than a thickness of the wall at the cylindrical surface, and wherein an annular area of the bonnet flow path at a radial plane intersecting the convex surface is less than an annular area of the bonnet flow path at a radial plane intersecting the cylindrical surface, the radial plane intersecting the convex surface and the radial plane intersecting the cylindrical surface each being perpendicular to the longitudinal axis.

2. The pump according to claim 1, wherein a longitudinal direction of the extension tube is parallel to the longitudinal axis, and wherein a longitudinal extent of the second inlet aperture lies at least partly between an inlet of the extension tube and an outlet of the extension tube along the longitudinal direction.

3. The pump according to claim 2, wherein an entirety of the longitudinal extent of the second inlet aperture lies between the inlet of the extension tube and the outlet of the extension tube along the longitudinal direction.

4. The pump according to claim 2, wherein a vector normal to the second inlet aperture is substantially perpendicular to the longitudinal axis.

5. The pump according to claim 1, wherein a longitudinal direction of the extension tube is parallel to the longitudinal axis, and wherein a longitudinal extent of the extension tube lies entirely within a longitudinal extent of the second internal surface of the bonnet along the longitudinal direction.

6. The pump according to claim 1, wherein a longitudinal direction of the extension tube is parallel to the longitudinal axis, and a vector normal to the first inlet aperture is substantially parallel to the longitudinal axis.

7. The pump according to claim 6, wherein the vector normal to the first inlet aperture is substantially collinear with the longitudinal axis.

8. The pump according to claim 1, wherein the external surface of the extension tube is not contiguous with the internal surface of the extension tube near an outlet end of the extension tube.

9. The pump according to claim 1, wherein the thickness of the wall at the convex surface is at least twice as thick as the thickness of the wall at the cylindrical surface.

10. A fluid system, comprising:

a pump having an inlet and an outlet;

an extension tube fluidly coupled to the inlet of the pump, a wall of the extension tube having an internal surface disposed opposite an external surface; and a bonnet having a second internal surface defining a first inlet aperture and a second inlet aperture therethrough, the first inlet aperture and the second inlet aperture being in fluid communication with the inlet of the pump via the extension tube, the second internal surface of the bonnet and the external surface of the extension tube defining a bonnet flow path therebetween, the outlet of the pump being in fluid communication with the inlet of the pump via the second inlet aperture and the bonnet flow path, wherein the external surface of the extension tube is contiguous with the internal surface of the extension tube at an inlet end of the extension tube and includes a convex surface located near the inlet end of the extension tube, and a cylindrical surface disposed between the convex surface and the volute along a longitudinal axis of the extension tube, wherein a thickness of the wall at the convex surface is greater than a thickness of the wall at the cylindrical surface, and wherein an annular area of the bonnet flow path at a radial plane intersecting the convex surface is less than an annular area of the bonnet flow path at a radial plane intersecting the cylindrical surface, the radial plane intersecting the convex surface and the radial plane intersecting the cylindrical surface each being perpendicular to the longitudinal axis.

11. The fluid system of claim 10, further comprising a fluid reservoir in fluid communication with the inlet of the pump via the first inlet aperture of the bonnet.

12. The fluid system of claim 10, further comprising a filter having an inlet and an outlet, the inlet of the filter being in fluid communication with the outlet of the pump, and the outlet of the filter being in fluid communication with the inlet of the pump via the bonnet flow path.

13. A method for operating a fluid system, the fluid system including a pump having an inlet and an outlet;

an extension tube fluidly coupled to the inlet of the pump, a wall of the extension tube having an internal surface disposed opposite an external surface, and a bonnet having a second internal surface defining a first inlet aperture and a second inlet aperture therethrough, the second internal surface of the bonnet and the external surface of the extension tube defining a bonnet flow path therebetween, wherein the external surface of the extension tube is contiguous with the internal surface of the extension tube at an inlet end of the extension tube and includes a convex surface located near the inlet end of the extension tube, and a cylindrical surface disposed between the convex surface and the volute along a longitudinal axis of the extension tube, wherein a thickness of the wall at the convex surface is greater than a thickness of the wall at the cylindrical surface, and wherein an annular area of the bonnet flow path at a radial plane intersecting the convex surface is less than an annular area of the bonnet flow path at a radial plane intersecting the cylindrical surface, the radial plane intersecting the convex surface and the radial plane intersecting the cylindrical surface each being perpendicular to the longitudinal axis; the method comprising:

flowing a first fluid from the outlet of the pump to the inlet of the pump via the second inlet aperture and the bonnet flow path;

flowing a second fluid from a reservoir to the inlet of the pump via the first inlet aperture; and combining the first fluid with the second fluid upstream of a volute of the pump.

* * * * *